United States Patent [19]

Nakajima et al.

[11] 4,163,435

[45] Aug. 7, 1979

[54] EXHAUST GAS RECIRCULATION CONTROL SYSTEM

[75] Inventors: Yasuo Nakajima, Yokosuka; Hiroshi Kuroda, Tokyo; Yoshimasa Hayashi, Yokohama, all of Japan

[73] Assignee: Nissan Motor Company, Limited, Japan

[21] Appl. No.: 830,865

[22] Filed: Sep. 6, 1977

[30] Foreign Application Priority Data

Sep. 7, 1976 [JP] Japan ..... 51/107085
Sep. 7, 1976 [JP] Japan ..... 51/107086

[51] Int. Cl.[2] ..... F02M 25/06
[52] U.S. Cl. ..... 123/119 A
[58] Field of Search ..... 123/119 A

[56] References Cited

U.S. PATENT DOCUMENTS

| | | | |
|---|---|---|---|
| 1,679,521 | 8/1928 | Good | 123/119 A |
| 3,636,934 | 1/1972 | Nakajima et al. | 123/119 A |
| 3,643,640 | 2/1972 | Kraus | 123/119 A |
| 3,791,144 | 2/1974 | Lang | 123/119 A |
| 3,961,610 | 6/1976 | Thurston | 123/119 A |
| 3,981,283 | 9/1976 | Kaufman | 123/119 A |
| 4,043,304 | 8/1977 | Stumpp et al. | 123/119 A |
| 4,094,285 | 6/1978 | Oyama et al. | 123/119 A |

FOREIGN PATENT DOCUMENTS

| | | | |
|---|---|---|---|
| 2225852 | 1/1973 | Fed. Rep. of Germany | 123/119 A |
| 2232705 | 1/1974 | Fed. Rep. of Germany | 123/119 A |

*Primary Examiner*—Wendell E. Burns
*Attorney, Agent, or Firm*—Robert E. Burns; Emmanuel J. Lobato; Bruce L. Adams

[57] ABSTRACT

A vacuum signal is produced, which is representative of a function of the flow rate of engine taken air and which is employed for directly or indirectly operating a diaphragm unit of an exhaust gas recirculation control valve, by admitting atmospheric air into a vacuum from a vacuum source by employing a solenoid valve in such a manner that the solenoid valve varies the amount of admitted atmospheric air in accordance with the flow rate of engine taken air.

15 Claims, 5 Drawing Figures

EXHAUST GAS RECIRCULATION CONTROL SYSTEM

BACKGROUND OF THE INVENTION

1. Field of the Invention

The present invention relates generally to an exhaust gas recirculation (EGR) control system for an internal combustion engine equipped with an electronically controlled fuel injection device and particularly to an EGR control system for an internal combustion engine lacking an intake passageway provided with a venturi in which system it is impossible to employ the so-called venturi vacuum for operating a diaphragm unit of an EGR control valve so that the EGR control valve controls the EGR amount in accordance with the flow rate of engine taken air.

2. Description of the Prior Art

As is well known in the art, an internal combustion engine is provided with an exhaust gas recirculation (EGR) control system for reducing the maximum temperature of combustion in the engine to reduce the production of nitrogen oxides (NOx) of noxious emissions of the engine by recirculating exhaust gases of the engine into air taken thereinto. When the EGR amount of engine exhaust gases thus recirculated is increased, since on the one hand although the effect of reducing the production of nitrogen oxides is increased, on the other hand a bad influence exerted on the operational performance of the engine is increased, it is necessary to control the EGR amount to maintain the EGR rate of the EGR amount to the amount of engine taken air at a desired constant value in all operating ranges of the engine as a rule.

For this purpose, in an internal combustion engine including an intake passageway provided therein with a carburetor venturi, an EGR control valve for controlling the EGR amount is operated by operating a diaphragm unit in accordance with a vacuum in the venturi which is highly reliable as a function of the flow rate of engine taken air or in accordance with an amplified venturi vacuum.

However, since an internal combustion engine equipped with an electronically controlled fuel injection device includes no intake passageway provided therein with a venturi, it is impossible to employ a venturi vacuum for operating a diaphragm unit of an EGR control valve. In this instance, it is undesirable to provide a venturi in the intake passageway of the engine of this type as a solution to this problem. This is because the provision of a venturi in the intake passageway nullifies an advantage of the engine that the resistance to the flow of air taken into the engine is small so that the engine is superior in operational performance owing to no provision of a venturi in the intake passageway.

SUMMARY OF THE INVENTION

It is, therefore, an object of the invention to provide an EGR control system for an internal combustion engine lacking an intake passageway provided with a venturi in which system a vacuum is produced and employed for operating a diaphragm unit of an EGR control valve which vacuum is representative of a function of the flow rate of engine taken air.

This object is accomplished by producing an electric signal representative of the flow rate of engine taken air sensed by an air flow sensor provided in the intake passageway, and by admitting atmospheric air into a vacuum from a vacuum source in accordance with the electric signal by employing a solenoid valve operated by the electric signal to provide a vacuum signal representative of a function of the flow rate of engine taken air which signal is employed for directly or indirectly operating the diaphragm unit of the EGR control valve.

BRIEF DESCRIPTION OF THE DRAWINGS

This and other features and advantages of the invention will become more apparent from the following detailed description taken in connection with the accompanying drawings in which.

DESCRIPTION OF THE PREFERRED EMBODIMENTS

Figure 1:
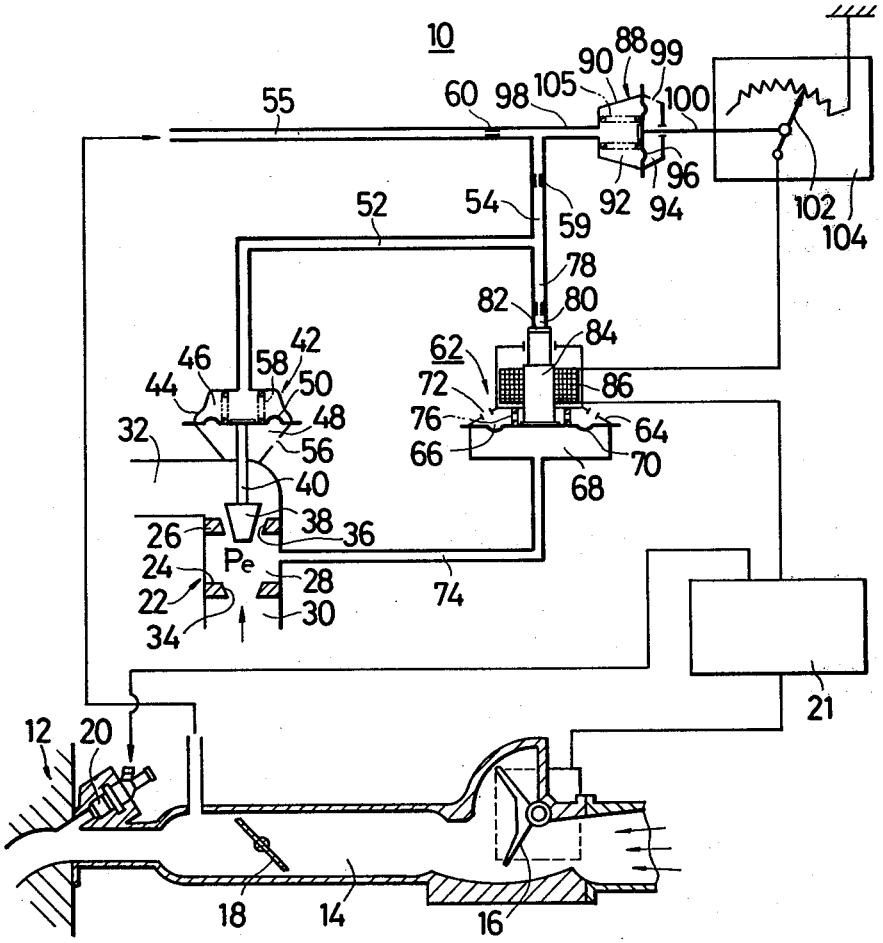
FIG. 1 is a schematic view of a first preferred embodiment of an exhaust gas recirculation (EGR) control system according to the invention.

Referring to FIG. 1 of the drawings, there is shown an exhaust gas recirculation (EGR) control system according to the invention. The EGR control system, generally designated by the reference numeral 10, is combined with an engine 12 of an electronically controlled fuel injection type. The engine 12 includes an intake passageway 14 providing communication between the atmosphere and the engine 12 for conducting air thereinto, an air flow meter 16 provided in the intake passageway 14, a throttle valve 18 rotatably mounted in the intake passageway 14 downstream of the air flow meter 16 for controlling the flow rate of air taken into the engine 12, and a fuel injection control valve or injector 20 for injecting fuel into air conducted by the intake passageway 14 through the throttle valve 18. The air flow meter 16 detects the flow rate of air taken by the engine 12 and generates an electric output signal representative of the detected air flow rate. The air flow meter 16 is electrically connected to an electronic control circuit or unit 21 to feed the output signal of the meter 16 thereto. The electronic control circuit 21 is electrically connected to the fuel injection valve 20 and determines, in accordance with the output signal from the air flow meter 16, the basic flow rate of fuel injected from the fuel injection valve 20. The electronic control circuit 21 is also electrically connected to various kinds of detectors (not shown) to receive electric output signals therefrom and determines, in accordance with the output signals received, fuel injection time, adjustment or correction of the amount of injected fuel, and so on.

The EGR control system 10 comprises an EGR passageway 22 providing communication between an exhaust gas passageway (not shown) of the engine 12 and the intake passageway 14 downstream of the throttle valve 18 for recirculating or conducting exhaust gases of the engine 12 into the intake passageway 14. The EGR passageway 22 is formed therein with partition members 24 and 26 which divide the EGR passageway 22 into a chamber 28 defined between the partition members 24 and 26 and upstream and downstream parts 30 and 32 located respectively upstream and downstream of the chamber 28. The partition member 24 is formed therethrough with an orifice 34 which provides communication between the upstream part 30 and the chamber 28 to form a restriction of the EGR passageway 22 which controls the flow rate of recirculated engine exhaust gases. The partition member 26 is formed therethrough with an aperture or passage 36 which provides communication between the chamber 28 and the downstream part 32.

An EGR control valve 38 is disposed in the EGR passageway 22 movably relative to the aperture 36 to control the effective cross sectional area thereof and therefore the pressure Pe in the chamber 28. The EGR control valve 38 includes a valve stem 40 extending therefrom externally of the EGR passageway 22, and a diaphragm unit 42 for operating the EGR control valve 38. The diaphragm unit 42 comprises a housing 44 having first and second chambers 46 and 48, and a flexible diaphragm 50 isolating the chambers 46 and 48 from each other. The chamber 46 communicates with the intake passageway 14 downstream of the throttle valve 18 through passages or conduits 52, 54 and 55 to receive an engine suction vacuum, while the chamber 48 communicates with the atmosphere through an opening 56. The diaphragm 50 is operatively connected to the EGR control valve 38 through the valve stem 40 in such a manner that the EGR control valve 38 is operated to increase and reduce the effective cross sectional area of the aperture 36 to reduce and increase the pressure Pe in the chamber 28 in accordance with increases and decreases in the working vacuum in the chamber 46, respectively. A spring 58 is provided to urge the diaphragm 50 in a direction opposed by the atmospheric pressure in the chamber 48. The passages 54 and 55 are formed therein with orifices 59 and 60, respectively.

It is desirable to set the cross sectional area of the orifice 34 and the degree of opening of the EGR control valve 38 in such a manner that the pressure Pe in the chamber 28 becomes a vacuum having an absolute value relatively greater than that of the pressure of exhaust gases of the engine which acts on the upstream port 30 of the EGR passageway 22.

A vacuum signal adjusting device 62 is provided which controls the vacuum in the chamber 46 and therefore the degree of opening of the EGR control valve 38 in accordance with the flow rate of air taken into the engine 12 so that the pressure Pe in the chamber 28 is reduced in accordance with increase in the flow rate of engine taken or intake air.

The vacuum signal adjusting device 62 comprises a housing 64 having first and second chambers 66 and 68, and a flexible diaphragm 70 isolating the chambers 66 and 68 from each other. The chamber 66 communicates with the atmosphere through an opening 72, while the chamber 68 communicates with the chamber 28 through a passage 74. A spring 76 is provided to urge the diaphragm 70 in a direction opposed by the pressure in the chamber 68. A passage or conduit 78 is branched off from the passages 52 and 54 toward the vacuum signal adjusting device 62 and has an open end 80 communicating with the atmosphere for admitting atmospheric air into the passage 78. A control valve 82 is disposed movably relative to the open end 80 to control the degree of communication of the passage 78 with the atmosphere and therefore the amount of atmospheric air admitted into the passage 78 for reducing the vacuum in the chamber 46. The control valve 82 is made of, for example, rubber. A plunger 84 is operatively connected at one end thereof to the control valve 82 and at the other end thereof to the diaphragm 70. The plunger 84 is made of a magnetic material such as, for example, iron to form a movable core of a solenoid coil 86 which is provided to surround the plunger 84 for electromagnetically operating same. The solenoid coil 86 is electrically connected to the electronic control circuit 21 to receive therefrom a control voltage which is proportional to the flow rate of engine taken air. The solenoid coil 86 is arranged to move the plunger 84 toward the open end 80 of the passage 78 in accordance with increase in the control voltage in opposition to the force of the spring 76 and to allow the spring 76 to move the plunger 84 away from the open end 80 in accordance with decrease in the control voltage.

Increase and decrease in the pressure in the chamber 68 move the diaphragm 70 and the plunger 84 toward and away from the open end 80 of the passage 78, respectively, in opposition to the electromagnetic force of the solenoid coil 86.

A diaphragm unit 88 is provided which includes a housing 90 having therein first and second chambers 92 and 94, and a flexible diaphragm 96 isolating the chambers 92 and 94 from each other. The chamber 92 communicates with the passage 54 upstream of the orifice 59 and the passage 55 downstream of the orifice 60 through a passage or conduit 98. The chamber 94 communicates with the atmosphere through an opening 99. The diaphragm 96 is operatively connected through an operating rod 100 and an insulator (not shown) to a slidable contact arm 102 of a variable resistor 104 which is connected in series with the solenoid coil 86. A spring 105 is provided to urge the diaphragm 96 in a direction opposed by the atmospheric pressure in the chamber 94. The diaphragm unit 88 and the variable resistor 104 are arranged in such a manner that the resistance of the variable resistor 104 is increased and reduced respectively by movements in opposite directions of the diaphragm 96 caused in response to increase and decrease in the vacuum in the chamber 92.

The EGR amount of engine exhaust gases recirculated into engine taken air is determined by both the effective cross sectional area of the orifice 34 and the difference between the pressure in the upstream part 30 of the EGR passageway 22 and the pressure Pe in the chamber 28. The upstream section 30 is subjected to the pressure (positive pressure) of exhaust gases of the engine 12 which is varied nearly in proportion to the flow rate of engine taken air. Accordingly, if the pressure Pe in the chamber 28 is maintained at a constant value, since the pressure differential of the upstream section 30 and the chamber 28 comes to a function of the flow rate of engine taken air, the EGR amount can be theoretically controlled in accordance with the flow rate of engine taken air, that is, it is possible to maintain the EGR rate at a constant value.

However, because of the absolute value of the pressure of engine exhaust gases being relatively small and variation in the pressure of engine exhaust gases being great due to pressure pulsation produced by the speed of the engine 12, flow resistance in the exhaust gas passageway of the engine 12, and so on, in fact the pressure differential of the upstream section 30 and the chamber 28 is not highly reliable as a function of the flow rate of engine taken air and accordingly the EGR rate is apt to be varied.

Thus, the EGR control system 10 is constructed and arranged in such a manner that it is made possible to nearly neglect the above-mentioned influence of variations in the pressure of engine exhaust gases on the EGR rate by setting the pressure Pe in the chamber 28 at a vacuum having a relatively great absolute value to make small the ratio of the pressure in the upstream section 30 occupying in the pressure differential of the upstream section 30 and the chamber 28 and by reducing and increasing the pressure Pe in the chamber 28 in accordance with increase and decrease in the flow rate of engine taken air, respectively.

The EGR control system 10 thus described is operated as follows:

The air flow meter 16 feeds an output signal based on the flow rate of engine taken air to the electronic control circuit 21 during running of the engine 12. The electronic control circuit 21 decides the flow rate of fuel injected into the engine taken air and concurrently feeds to the solenoid coil 86 a control voltage E varied in accordance with the flow rate of engine taken air sensed by the air flow meter 16.

A coil current or voltage passed through the solenoid coil 86 is determined by the resistance of the variable resistor 104 and the control voltage E from the electronic control circuit 21. Assuming that the resistance of the variable resistor 104 is now unvaried, the coil current is increased in accordance with increase in the control voltage E, that is, increase in the flow rate of engine taken air. In proportion to increase in the coil current, the movable core 84 of the solenoid coil 86 is moved upwards in the drawing by the electromagnetic force thereof in opposition to the force of the spring 76 to a position in which the force of the spring 76 is balanced with the electromagnetic force of the coil 86. This causes decrease in the degree of communication of the passage 78 with the atmosphere and therefore decrease in the amount of atmospheric air admitted into the passage 78 for reducing the suction vacuum conducted into the chamber 46 through the passages 55, 54 and 52. As a result, since the control vacuum in the chamber 46 is increased to move the diaphragm 50 upwards in the drawing, the degree of opening of the EGR control valve 38 is increased to reduce the flow resistance in the EGR passageway 22 downstream of the orifice 34 and concurrently to increase the influence of the engine suction vacuum exerted on the chamber 28. Accordingly, since the pressure Pe (the vacuum) in the chamber 28 is reduced (increased) to increase the pressure differential of the upstream section 30 and the chamber 28, the EGR amount is increased to maintain the EGR rate at a constant or predetermined value.

Conversely, when the air flow meter 16 detects decrease in the flow rate of engine taken air to reduce the control voltage applied to the solenoid coil 86, the electromagnetic force of the solenoid coil 86 is reduced to allow the spring 76 to move the diaphragm 70 and the plunger 84 downwards in the drawing to a position in which the force of the spring 76 is balanced with the electromagnetic force of the solenoid coil 86. This causes increase in the degree of communication of the passage 78 with the atmosphere and therefore increase in the amount of atmospheric air admitted into the passage 78. As a result, since the control vacuum in the chamber 46 is reduced to cause decrease in the degree of opening of the EGR control valve 38, the pressure Pe in the chamber 28 is increased to reduce the EGR amount to maintain the EGR rate at the predetermined value.

Since the engine suction vacuum acts on the downstream section 32 of the EGR passageway 22, when it is varied even if the degree of opening of the EGR control valve 38 is unvaried, the pressure Pe in the chamber 28 is varied so that the EGR rate is varied.

In order to correct or restore the pressure Pe thus varied to a former value, the feedback of the pressure Pe to the chamber 68 of the vacuum signal adjusting device 62 is performed in the following manner.

When the engine suction vacuum is increased to reduce the pressure Pe in the chamber 28 and therefore the pressure in the chamber 68, the diaphragm 70 and the plunger 84 are moved downwards by the force of the spring 76 in opposition to the electromagnetic force of the solenoid coil 86 to increase the degree of opening of the passage 78 to the atmosphere and therefore the amount of atmospheric air admitted into the passage 78. As a result, since the control vacuum in the chamber 46 is reduced to reduce the degree of opening of the EGR control valve 38, the degree of the influence of the suction vacuum exerted on the pressure Pe in the chamber 28 is reduced to return or increase the pressure Pe to a former value.

Conversely, when the pressure Pe in the chamber 28 is increased due to decrease in the engine suction vacuum, since the diaphragm 70 and the plunger 84 are moved upwards by the pressure in the chamber 68 in opposition to the electromagnetic force of the solenoid coil 86 to increase the control vacuum in the chamber 46, the degree of opening of the EGR control valve 38 is increased so that the pressure Pe in the chamber 28 is returned or reduced to a former value.

Since the pressure Pe is controlled by performing the feedback thereof to the chamber 68 in this manner, the EGR amount is accurately controlled in accordance with only the control voltage to the solenoid coil 86, that is, the flow rate of engine taken air independently of the engine suction vacuum.

When the engine 12 is running in a high speed and low load operating condition, since the production of nitrogen oxides (NOx) is usually small, it is desirable to reduce the EGR rate. This is to retain the stability of operation of the engine 12. This problem is solved by the diaphragm unit 88 and the variable resistor 104 in the following manner.

When the engine 12 is running at a low load and high speed operating condition at which the suction vacuum in the intake passage 14 and the control vacuum in the chamber 46 are increased above predetermined values, since the diaphragm 96 of the diaphragm unit 88 is moved leftwards in the drawing in opposition to the force of the spring 105, the contact arm 102 of the variable resistor 104 is rotated counterclockwise in the drawing through the operating rod 100 to increase the resistance of the variable resistor 104. Since the variable resistor 104 is connected in series with the solenoid coil 86, when the control voltage applied to the solenoid coil 86 is unvaried, the coil current is reduced by the increase in the resistance of the variable resistor 104 so that the plunger 84 is moved downward by the force of the spring 76 to a position in which the force of the spring 76 is balanced with the electromagnetic force of the solenoid coil 86. Accordingly, since the control vacuum in the chamber 46 is reduced in accordance with the amount of such a movement of the plunger 84 away from the passage 78 to reduce the degree of opening of the EGR control valve 38, the EGR amount is reduced to increase the fuel economy and the operating performance of the engine 12. In this instance, when the control voltage applied to the solenoid coil 86 is increased or reduced, the rate of increase or decrease in the coil current is reduced, respectively.

Since the resistance of the variable resistor 104 shown in FIG. 1 is continuously and gradually varied in accordance with change in the working vacuum in the vacuum chamber 92 so that the EGR rate is smoothly varied, change in the operation of the engine 12 is smoothly performed to prevent a rapid change in the output.

According to circumstances, a different variable resistor can be employed the resistance of which is stepwise variable in place of the variable resistor 104 shown in FIG. 1.

Figure 2:
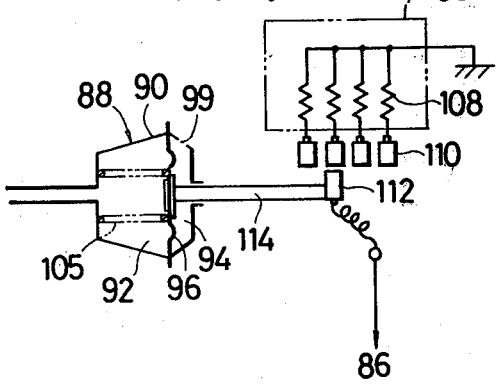
FIG. 2 is a schematic view of another example of a variable resistor forming part of the EGR control system shown in FIG. 1.

Referring to FIG. 2 of the drawings, there is shown an example of such a different variable resistor. The variable resistor 106 shown in FIG. 2 comprises a plurality of resistances 108 which are different from each other and which are connected in parallel. The resistances 108 have terminals or stationary contacts 110, respectively. A movable contact 112 is located movably for engagement or contact with each of the stationary contacts 110 and is electrically connected to the solenoid coil 86. The diaphragm 96 of the diaphragm unit 88 is operatively connected through an operating rod 114 to the movable contact 112 for switching off engagement of the movable contact 112 between the stationary contacts 110 in accordance with the working vacuum in the chamber 92.

Figure 3:
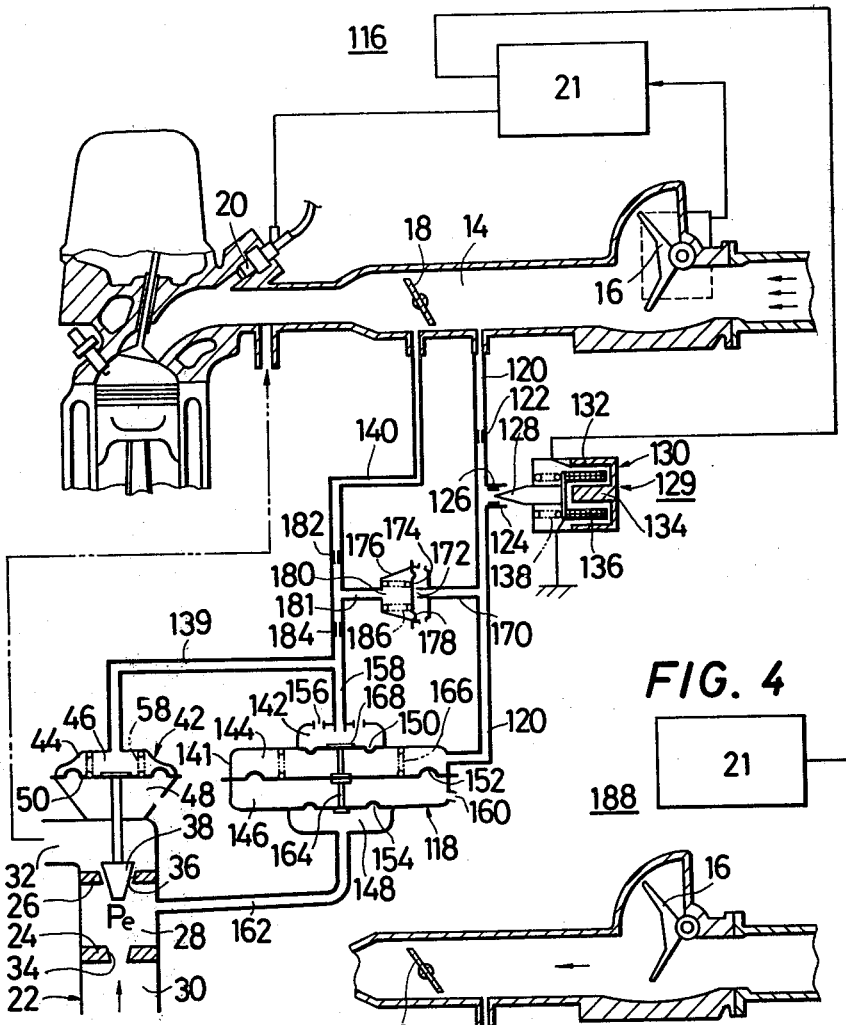
FIG. 3 is a schematic view of a second preferred embodiment of an EGR control system according to the invention.

Referring to FIG. 3 of the drawings, there is shown a second preferred embodiment of an EGR control system according to the invention. In FIG. 3, the same component elements as those of the EGR control system 10 shown in FIG. 1 are designated by the same reference numerals as those used in FIG. 1 and with respect to FIG. 2, the description as to the same component elements is omitted for purpose of brevity. The EGR control system, generally designated by the reference numeral 116, is characterized in that a vacuum signal adjusting device 118 is provided which is fed with as a working vacuum, a vacuum prevailing in the intake passageway 14 between the air flow meter 16 and the throttle valve 18 and modified to represent a function of the flow rate of engine taken air.

The air flow meter 16 is at all times urged by a nearly constant moment produced by a spring (not shown) in a direction opposed by the flow of air passed in the intake passageway 14. As a result, the difference between the pressures in sections of the intake passageway 14 upstream and downstream of the air flow meter 16 is at all times made constant and the air flow meter 16 is operated to vary the degree of opening of the intake passageway 14 in proportion to the flow rate of air taken into the engine 12.

Accordingly, the pressure Pa in the intake passageway 14 between the air flow meter 16 and the throttle valve 18 is a nearly constant negative pressure which is represented as the difference between the atmospheric pressure and a drop in pressure produced by the air flow meter 16.

A passage or conduit 120 communicates with the intake passageway 14 between the air flow meter 16 and the throttle valve 18 for receiving the above-mentioned negative pressure. The passage 120 has an orifice 122 formed therein. A passage 124 is branched off from the passage 120 downstream of the orifice 122 and has an open end communicating with the atmosphere for admitting atmospheric air into the passage 120. The passage 124 is formed therein with an orifice 126. A control valve 128 is provided movably relative to the open end of the passage 124 to control the degree of opening of the passage 124 to the atmosphere. The control valve 128 is operated by an output signal of the electronic control circuit 21 to reduce and increase the degree of opening of the passage 124 in accordance with increase and decrease in the flow rate of engine taken air, respectively. An example of solenoid means 129 for operating the control valve 128 is shown in FIG. 3 and the solenoid means 129 comprises, for example, a cylindrical stationary core 130 made of a magnetic material which has an outer portion 132 forming the south pole and an inner or control portion 134 forming the north pole, as shown in FIG. 3. A movable solenoid coil 136 is located in the stationary core 130 between the outer and inner portions 132 and 134. The solenoid coil 136 is operatively connected to the control valve 128 and is electrically connected to the electronic control circuit 21 to receive a control signal therefrom. A spring 138 is provided to urge the control valve 128 in a direction in which the control valve 128 increases the degree of opening of the passage 124 to the atmosphere. The control valve 128 is operated by the solenoid means 129 so that it continuously and gradually varies the degree of opening of the passage 124 in proportion to the flow rate of engine taken air.

The control valve 128 may be operated to on and off control or open and close the passage 124 in place of continuously varying the degree of opening of the passage 124 as mentioned above. In this instance, solenoid means for operating the control valve 128 is fed with, as control signals from the electronic control circuit 21, pulse signals serving to vary the rate of on or open time and off or closed time of the control valve 128 in accordance with the flow rate of engine taken air.

By controlling the degree of opening of the control valve 128 in accordance with the flow rate of engine taken air in this manner to control the amount of atmospheric air admitted into the passage 120 and therefore to control the degree of dilution of the nearly constant negative pressure from the intake passageway 14 by the admitted atmospheric air, there is provided in the passage 120 a vacuum increased and reduced in accordance with increase and decrease in the flow rate of engine taken air, respectively, which is employed as a working vacuum or an input signal in the vacuum signal adjusting device 118 as described hereinafter.

The chamber 46 of the diaphragm unit 42 communicates with the intake passageway 14 downstream of the throttle valve 18 through passages or conduits 139 and 140. Alternatively, the chamber 46 may communicate with the intake passageway 14 adjacent to the throttle valve 18 in its fully closed position.

The vacuum signal adjusting device 118 comprises a housing 141 having therein four chambers 142, 144, 146 and 148, and three flexible diaphragms 150, 152 and 154. The diaphragm 150 isolates the chambers 142 and 144 from each other. The diaphragm 152 isolates the chambers 144 and 146 from each other. The diaphragm 154 isolates the chambers 146 and 148 from each other. The chamber 142 communicates with the atmosphere through an opening 156 and with the passages 139 and 140 through a passage or conduit 158. The chamber 144 communicates with the passage 120 to receive the control vacuum varied in accordance with the flow rate of engine taken air. The chamber 146 communicates with the atmosphere through an opening 160. The chamber 148 communicates with the chamber 28 of the EGR passageway 22 through a passage or conduit 162 for performing the feedback of the pressure Pe in the chamber 28 into the chamber 148 to correct the pressure Pe, varied by the engine suction vacuum, to a former value. The diaphragms 150, 152 and 154 are fixedly connected to each other by a rod 164 so that they are operated integral with each other. A spring 166 is provided to urge the integral diaphragms 150, 152 and 154 in a direction opposed by the atmospheric pressure in the chamber 146. A control valve 168 is fixedly secured to the diaphragm 150 in the chamber 142 to control the degree of opening of the passage 158 to the chamber 142 and therefore the amount of atmospheric air admitted from the chamber 142 into the passage 158.

A relief passage or conduit 170 is branched off from the passage 120 between the orifice 122 and the vacuum adjusting device 118 and has an open end 172 providing communication between the passage 170 and the atmosphere. A relief valve 174 is disposed for opening and closing the open end 172 of the passage 170. The relief valve 174 includes a housing 176 and a flexible diaphragm 178 having on a side thereof a vacuum chamber 180 defined by the housing 176. The vacuum chamber 180 communicates with the passage 140 through a passage or conduit 181 to receive the suction vacuum from the intake passageway 14 through an orifice 182 and the atmospheric pressure from the passage 158 through an orifice 184. The diaphragm 178 is operatively connected to the relief valve 174 in such a manner as to move the relief valve 174 toward and away from the open end 172 of the passage 170 in response to decrease and increase in the vacuum in the chamber 180, respectively. A spring 186 is provided to urge diaphragm 178 and the relief valve 174 toward the open end 172. The diaphragm 178 is moved in opposition to the force of the spring 186 into a position in which the relief valve 174 opens the open end 172 when the vacuum in the chamber 180 is increased above a predetermined value.

The EGR control system 116 thus described is operated in the following manner.

Although the air flow meter 16 varies the degree of opening of the intake passageway 14 in accordance with the flow rate of engine taken air, the pressure differential of the sections of the intake passageway 14 downstream and upstream of the air flow meter 16 is nearly constant at all times. Although the intake passageway 14 downstream of the throttle valve 18 is subjected to the engine suction vacuum, the influence of the engine suction vacuum is almost not exerted on the intake passageway 14 upstream of the throttle valve 18. Since the pressure in the intake passageway 14 upstream of the air flow meter 16 is almost equal to the atmospheric pressure and is at a constant value, the intake passageway 14 between the air flow meter 16 and the throttle valve 18 is subjected to a constant vacuum. Usually, this vacuum is fairly higher than a vacuum produced in a venturi of a carburetor of an engine in a common operating range thereof.

The air flow meter 16 generates an output signal varied in accordance with the flow rate of engine taken air and applied to the electronic control circuit 21. The electronic control circuit 21 generates a control signal current for energizing the solenoid coil 136 of the control valve 128 in accordance with the flow rate of engine taken air.

When the flow rate of engine taken air is increased, the control signal current fed to the solenoid coil 136 is increased in proportion to increase in the flow rate of engine taken air to move the movable solenoid coil 136 in opposition to the force of the spring 138 to cause the control valve 128 to reduce the degree of opening of the open end of the passage 124 to the atmosphere. As a result, the amount of atmospheric air admitted into the passage 120 is reduced to increase the vacuum in the passage 120 in proportion to increase in the flow rate of engine taken air. This is because, since the vacuum conducted from the intake passageway 14 into the passage 120 is constant at all times, the degree of variation in the vacuum by the admitted atmospheric air is accurately proportional to the degree of opening of the control valve 128 and therefore the flow rate of engine taken air. Since the vacuum thus regulated or modified is highly reliable as a function of the flow rate of engine taken air, the EGR amount can be precisely controlled in proportion to the flow rate of engine taken air by employing the modulated vacuum as a working or control vacuum for directly or indirectly operating the EGR control valve 38 so that it is made possible to effectively reduce the production of nitrogen oxides without degrading the stability of operation of the engine 12.

For reducing to nearly zero the influence of variation in the pressure in the upstream section 30 of the EGR passagewy 22 exerted on the EGR rate to maintain same constant also in the EGR control system 116 similarly to the EGR control system 10 shown in FIG. 1, it is preferable that the restrictions 24, 34 and 26, 36 of the EGR passageway 22 are formed in such a manner that the pressure Pe in the chamber 28 is a vacuum having an absolute value greater than that of the pressure of exhaust gases of the engine 12, and the vacuum in the chamber 28 is increased in proportion to the modulated vacuum in the passage 120 and therefore the flow rate of engine taken air in the following manner.

The modulated vacuum in the passage 120 is conducted into the chamber 144 so that the diaphragm 152 is moved upwards in the drawing in accordance with increase in the vacuum in the chamber 144 in opposition to the force of the spring 166. Since the diaphragm 150 is moved upwards integrally with the diaphragm 152 so that the control valve 168 is moved to reduce the degree of opening of the passage 158 to the atmosphere, the amount of atmospheric air admitted into the passage 158 is reduced to increase the control vacuum in the chamber 46. As a result, since the diaphragm 50 of the diaphragm unit 42 is moved upwards to increase the degree of opening of the EGR control valve 38, the vacuum in the chamber 28 is increased due to increase in the influence of the engine suction vacuum on the chamber 28. Accordingly, since the pressure differential of the upstream section 30 and the chamber 28 is increased to increase the EGR amount, the EGR rate is maintained constant.

Conversely, when the flow rate of engine taken air is reduced, since the control current fed to the solenoid coil 136 is reduced so that the control valve 128 is moved to increase the degree of opening of the passage 124 to the atmosphere, the control vacuum in the chamber 46 is reduced to reduce the degree of opening of the EGR control valve 38 reversely to the case mentioned above. As a result, since the pressure Pe (vacuum) in the chamber 28 is increased (reduced) to reduce the EGR amount in accordance with decrease in the flow rate of engine taken air, the EGR rate is maintained constant.

Since the feedback of the pressure Pe in the chamber 28 into the chamber 148 of the vacuum signal adjusting device 118 is performed, when the pressure in the downstream section 32 of the EGR passageway 22 is varied due to variation in the engine suction vacuum, the pressure Pe in the chamber 28 is prevented from being varied in the following manner.

When the pressure Pe is reduced due to increase in the engine suction vacuum, since the diaphragm 154 is moved downwards in response to decrease in the pressure in the chamber 148 so that the control valve 168 is moved to increase the degree of opening of the passage 158 to the atmosphere, the control vacuum in the chamber 46 is reduced to reduce the degree of opening of the EGR control valve 38. As a result, the influence of the suction vacuum on the pressure Pe is reduced to return or increase the pressure Pe to a former value.

Conversely, when the pressure Pe is increased due to decrease in the engine suction vacuum, by operation reverse to that mentioned above the influence of the suction vacuum on the pressure Pe is increased to return or reduce the pressure Pe to a former value.

Although the EGR rate is maintained at a predetermined or constant value in this manner when the engine 12 is running in a normal operating range, the relief valve 174 is operated to reduce the EGR rate to increase the fuel economy and the operational performance of the engine 12 in the following manner when the engine 12 is running at an operating condition such as, for example, a high speed and low load condition in which it is desirable to reduce the EGR rate to improve the fuel economy.

When the vacuum in the chamber 180 is increased above a predetermined value by the engine suction vacuum increased due to a low load of the engine 12 and by the control vacuum in the chamber 46 increased due to a high speed of the engine 12, since the diaphragm 178 is moved leftwards in the drawing in opposition to the force of the spring 186 so that the relief valve 174 is moved to open the open end 172 of the passage 170, atmospheric air is admitted into the passage 120 to reduce the vacuum in the chamber 144. As a result, since the control vacuum in the chamber 46 is reduced similarly as mentioned hereinbefore, the EGR amount and therefore the EGR rate are reduced to increase the operational performance of the engine 12.

Figure 4:
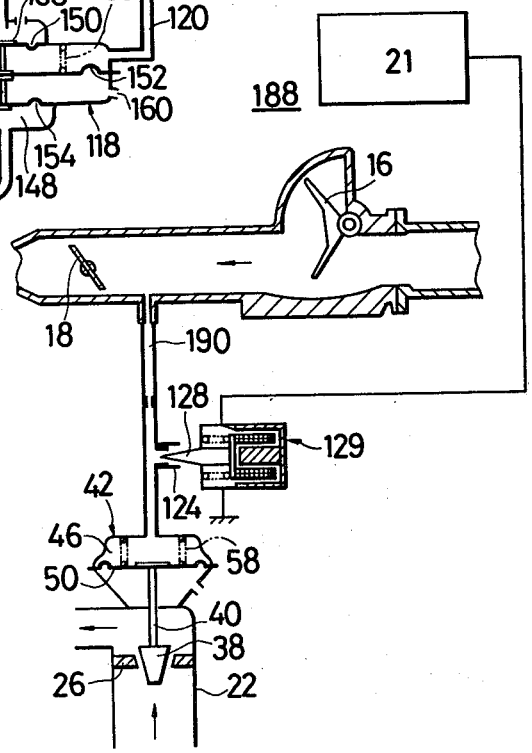
FIG. 4 is a schematic view of a third preferred embodiment of an EGR control system according to the invention.

Referring to FIG. 4 of the drawings, there is shown a third preferred embodiment of an EGR control system according to the invention. In FIG. 4, the same component elements as those of the EGR control system 116 shown in FIG. 3 are designated by the same reference numerals as those used in FIG. 3 and with respect to FIG. 4, the description as to the same component elements is omitted for purpose of brevity. The EGR control system, generally designated by the reference numeral 188, is characterized in that it is not provided with the partition member 24 and the vacuum signal adjusting device 118 provided in the EGR control system 116 of FIG. 3, and that the chamber 46 of the diaphragm unit 42 directly communicates with the intake passageway 14 between the air flow sensor 16 and the throttle valve 18 through a passage 190. The passage 190 is provided with the passage 124, the control valve 128 and the solenoid means 129 which serve to convert or regulate a vacuum from the intake passageway 14 into a control vacuum representative of a function of the flow rate of engine taken air, similarly to the EGR control system 116 of FIG. 3. Accordingly, when the flow rate of engine taken air is increased and reduced, since the control vacuum in the chamber 46 is increased and reduced to increase and reduce the degree of opening of the EGR control valve 38 and therefore the EGR amount, respectively, the EGR rate is maintained at a constant value. In the EGR control system 188, it is necessary to make the area of the diaphragm 50 of the diaphragm unit 42 tolerably greater than that of the diaphragm 50 of the EGR control system 116 of FIG. 3.

Figure 5:
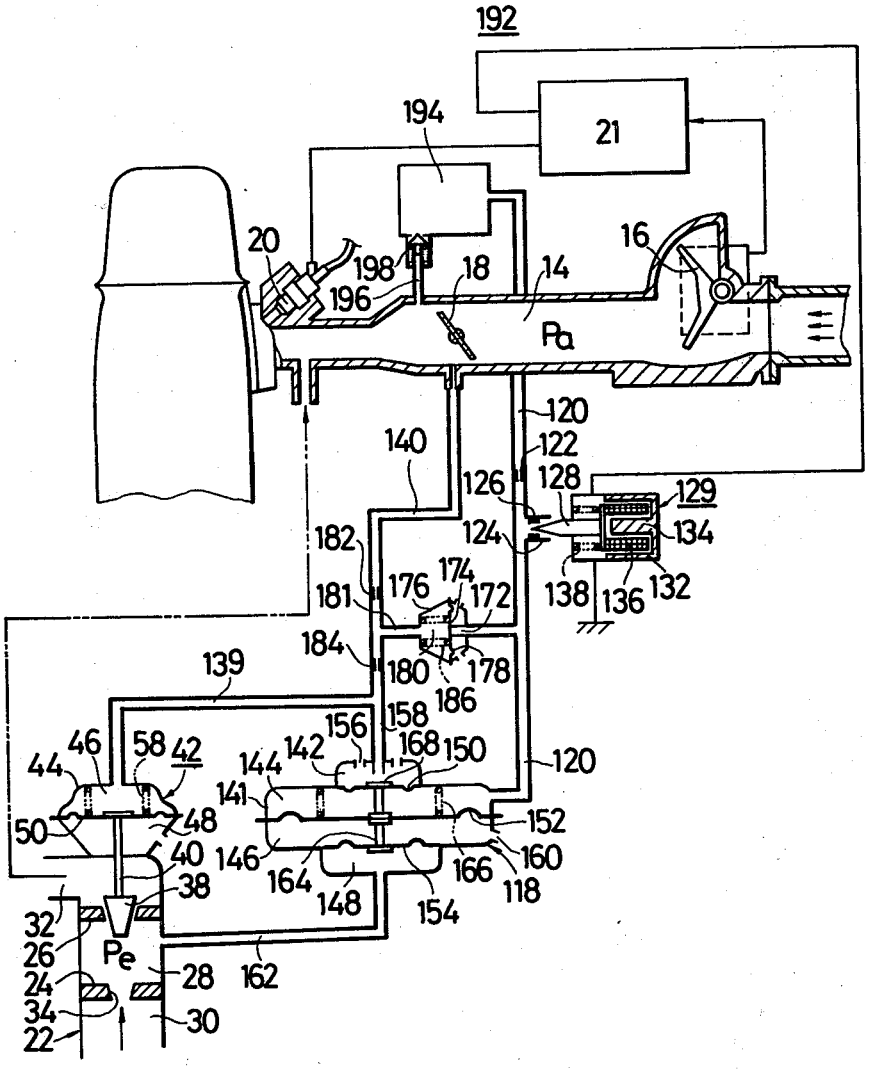
FIG. 5 is a schematic view of a fourth preferred embodiment of an EGR control system according to the invention.

Referring to FIG. 5 of the drawings, there is shown a fourth preferred embodiment of an EGR control system according to the invention. In FIG. 5, the same component elements as those of the EGR control system 116 shown in FIG. 3 are designated by the same reference numerals as those used in FIG. 3 and with respect to FIG. 5, the description as to the same component elements is omitted for purpose of brevity. The EGR control system, generally designated by the reference numeral 192, is characterized in that a vacuum contained in a vacuum tank 194 is employed in place of the intake passageway 14 between the air flow sensor 16 and the throttle valve 18 as a vacuum source for obtaining the control vacuum in the chamber 144 of the vacuum signal adjusting device 118. The vacuum tank 194 has a suitable volume or capacity and communicates through the passage 120 with the chamber 144 and with the intake passageway 14 downstream of the throttle valve 18 through a passage 196. A check valve 198 is provided in the passage 196 to permit fluid flow from the vacuum tank 194 to the intake passageway 14 and inhibit fluid flow from the intake passageway 14 to the vacuum tank 194.

It will be appreciated that the invention provides an EGR control system in which a vacuum from a vacuum source is converted into a control vacuum representative of a function of the flow rate of air taken into the engine by employing an electric parameter representative of the function and the control vacuum is employed for directly or indirectly operating a diaphragm unit of an EGR control valve so that the EGR amount is accurately controlled at a predetermined or constant rate to the flow rate of the engine taken air and therefore the production of nitrogen oxide is satisfactorily reduced without reducing the stability of operational performance of the engine even if the engine lacks an intake passageway provided with a venturi.

It will be appreciated that the invention provides an EGR control system which is capable of reducing the EGR rate to a proper value so that the production of nitrogen oxides is reduced without reducing the fuel economy and the operational performance of the engine in a high speed and low load operating range of the engine in which the production of nitrogen oxides is originally small.

What is claimed is:

1. An exhaust gas recirculation control system in combination with an engine of an electronically controlled fuel injection type including an intake passageway, an exhaust gas passageway and first means for sensing the flow rate of air taken into the engine and for generating an output signal representative of the sensed flow rate of the engine taken air, said exhaust gas recirculation (EGR) control system comprising passage means communicating with a vacuum source for receiving a vacuum therefrom and with the atmosphere for receiving atmospheric air therefrom, electric means electrically connected to said first means for receiving said output signal therefrom and for generating an electromagnetic force corresponding to said output signal, second means operated for converting said vacuum from said vacuum source into a control vacuum representative of a function of the flow rate of the engine taken air by controlling the amount of atmospheric air, admitted into said passage means, in accordance with said electromagnetic force, an EGR passageway for providing communication between the exhaust gas passageway and the intake passageway for recirculating exhaust gases of the engine into the intake passageway, an EGR control valve disposed in said EGR passageway for controlling the effective cross sectional area thereof, and means for operating said EGR control valve in accordance with said control vacuum so that said EGR control valve increases and reduces the effective cross sectional area of said EGR passageway in accordance with increase and decrease in the flow rate of the engine taken air, respectively.

2. An exhaust gas recirculation control system as claimed in claim 1, further comprising a restriction located in said EGR passageway upstream of said EGR control valve for restricting said EGR passageway, said EGR control valve and said restriction defining therebetween a first chamber; said operating means including a first flexible diaphragm, and means defining on a side of said first diaphragm a second chamber communicating with said passage means for receiving said control vacuum therefrom, said first diaphragm being operatively connected to said EGR control valve so that said EGR control valve is operated to reduce and increase the pressure in said first chamber in accordance with increase and decrease in said control vacuum in said second chamber, respectively; and third means for, when the pressure in said first chamber is varied, increasing and reducing said control vacuum is said second chamber by reducing and increasing the amount of atmospheric air, admitted into said passage means, in accordance with increase and decrease in the pressure in said first chamber.

3. An exhaust gas recirculation control system as claimed in claim 2, in which said third means comprises a second flexible diaphragm;

means defining on a side of said second diaphragm a third chamber communicating with said first chamber for receiving the pressure therein; and a second control valve located movably relative to said passage means, said second diaphragm being operatively connected to said second control valve so that said second control valve is operated to reduce and increase the degree of opening of said passage means to the atmosphere in accordance with increase and decrease in the pressure in said third chamber, respectively, said electric means comprising a working coil electrically connected to said first means for receiving said output signal therefrom and for generating said electromagnetic force, said second means comprising a plunger extending through said working coil and operatively connected to said second control valve so that said second control valve is operated to reduce and increase the degree of opening of said passage means to the atmosphere in accordance with increase and decrease in said electromagnetic force.

4. An exhaust gas recirculation control system as claimed in claim 2, in which said third means comprises a second flexible diaphragm;

means defining on a side of said second diaphragm a third chamber communicating with said first chamber for receiving the pressure therein; and a second control valve located for controlling the degree of opening of said passage means to atmosphere, said second diaphragm being operatively connected to said second control valve so that said second control valve is operated to reduce and increase the degree of opening of said passage means to the atmosphere in accordance with increase and decrease in the pressure in said third chamber, respectively; said electric means comprising a working coil electrically connected to said first means for receiving said output signal therefrom and generating said electromagnetic force, said second means comprising a plunger extending through said working coil and operatively connected to said second control valve so that said second control valve is operated to reduce and increase the degree of opening of said passage means to the atmosphere in accordance with increase and decrease in said electromagnetic force, variable resistance means electrically connected in series with said working coil and the resistance of which is variable, a third flexible diaphragm, and means defining on a side of said third diaphragm a fourth chamber communicating with the intake passageway downstream of a throttle valve rotatably mounted therein and with said passage means, said third diaphragm being operatively connected to said variable resistance means so that it increases the resistance of said variable resistance means for reducing said electromagnetic force of said working coil in response to a vacuum in said fourth chamber which is increased above a predetermined value.

5. An exhaust gas recirculation control system as claimed in claim 4, in which said variable resistance means comprises a variable resistor the resistance of which is continuously variable in accordance with movement of said third diaphragm.

6. An exhaust gas recirculation control system as claimed in claim 4, in which said variable resistance means comprises a plurality of resistances connected in parallel with each other and different from each other, and means operatively connected to said third diaphragm for switching off the connection of said working coil between said plurality of resistances in accordance with movement of said third diaphragm.

7. An exhaust gas recirculation control system as claimed in claim 1, in which said vacuum source is a vacuum source which feeds a nearly constant vacuum.

8. An exhaust gas recirculation control system as claimed in claim 7, in which the engine includes a throttle valve rotatably mounted in the intake passageway, the first means including an air flow meter located in the intake passageway upstream of the throttle valve for sensing the flow rate of the engine taken air, said vacuum source being the intake passageway located between the air flow meter and the throttle valve.

9. An exhaust gas recirculation control system as claimed in claim 7, in which the engine includes a throttle valve rotatably mounted in the intake passageway, said vacuum source comprising a vacuum tank communicating with the intake passageway downstream of the throttle valve for storing an engine suction vacuum.

10. An exhaust gas recirculation system as claimed in claim 7, further comprising a restriction located in said EGR passageway upstream of said EGR control valve for restricting said EGR passageway, said EGR control valve and said restriction defining therebetween a first chamber; said operating means including a first flexible diaphragm, and means defining on a side of said first diaphragm a second chamber communicating with a second vacuum source for receiving a vacuum therefrom, said first diaphragm being operatively connected to said EGR control valve so that said EGR control valve is operated to reduce and increase the pressure in said first chamber in accordance with increase and decrease in the vacuum in said second chamber, respectively, third means providing communication said second chamber and the atmosphere for admitting atmospheric air into said vacuum fed from said second vacuum source, fourth means for increasing and reducing the vacuum in said second chamber by reducing and increasing the amount of atmospheric air, admitted into said third means, in accordance with increase and decrease in said control vacuum in said passage means, and fifth means for, when the pressure in said first chamber is varied, increasing and reducing the vacuum in said second chamber by reducing and increasing the amount of atmospheric air, admitted into said third means, in accordance with increase and decrease in the pressure in said first chamber.

11. An exhaust gas recirculation control system as claimed in claim 10, in which said passage means has a passage providing communication between said passage means and the atmosphere, said second means comprising a second control valve for controlling the degree of opening of said passage to the atmosphere, the degree of opening of said second control valve being controlled by said electric means, said electric means comprising sixth means for varying the degree of opening of said second control valve in proportion to said output signal of said first means.

12. An exhaust gas recirculation control system as claimed in claim 11, in which said sixth means comprises a cylindrical stationary core made of a magnetic material and having an outer portion forming the south pole and an inner portion forming the north pole, a movable working coil movably located in said stationary core between said outer and inner portions and operatively connected to said second control valve for operating same by said electromagnetic force, said working coil being electrically connected to said first means for receiving said output signal therefrom, and a spring for urging said working coil and said second control valve in a direction opposed by said electromagnetic force.

13. An exhaust gas recirculation control system as claimed in claim 10, in which said passage means has a passage providing communication between said passage means and the atmosphere, said second means comprising a second control valve for controlling the degree of opening of said passage to the atmosphere, the degree of opening of said second control valve being controlled by said electric means, said first means comprising means for generating a pulse signal which causes said electric means to vary the rate of open time and closed time of said second control valve in accordance with the flow rate of the engine taken air.

14. An exhaust gas recirculation control system as claimed in claim 7, further comprising a restriction located in said EGR passageway upstream of said EGR control valve for restricting said EGR passageway, said EGR control valve and said restriction defining therebetween a first chamber; said operating means including a first flexible diaphragm, and means defining on a side of said first diaphragm a second chamber communicating with a second vacuum source for receiving a vacuum therefrom, said first diaphragm being operatively connected to said EGR control valve so that said EGR control valve is operated to reduce and increase the pressure in said first chamber in accordance with increase and decrease in the vacuum in said second chamber, respectively, third means providing communication between said second chamber and the atmosphere for admitting atmospheric air into said vacuum fed from said second vacuum source, means defining a third chamber communicating with said passage means for receiving said control vacuum therefrom, fourth means for increasing and reducing the vacuum in said second chamber by reducing and increasing the amount of atmospheric air, admitted into said third means, in accordance with increase and decrease in said control vacuum in said third chamber, means defining a fourth chamber communicating with said first chamber for receiving the pressure therein, fifth means for, when the pressure in said fourth chamber is varied, increasing and reducing the vacuum in said second chamber by reducing and increasing the amount of atmospheric air, admitted into said third means, in accordance with increase and decrease in the pressure in said fourth chamber, sixth means for providing communication between the atmosphere and said passage means for admitting atmospheric air thereinto, means defining a fifth chamber which communicates with the intake passageway downstream of a throttle valve, rotatably mounted therein, for receiving an engine suction vacuum and which communicates with said second chamber for receiving said vacuum therein, seventh means for normally obstructing communication between said sixth means and the atmosphere and for providing the last-mentioned communication in response to a vacuum in said fifth chamber which is increased above a predetermined value.

15. An exhaust gas recirculation control system as claimed in claim 7, in which said operating means includes a flexible diaphragm, and means defining on a side of said diaphragm a chamber communicating with said passage means for receiving said control vacuum therefrom, said diaphragm being operatively connected to said EGR control valve so that said EGR control valve is operated to increase and reduce the effective cross sectional area of said EGR passageway in accordance with increase and decrease in said control vacuum in said chamber, respectively.

* * * * *